US008584625B2

(12) United States Patent
Ando

(10) Patent No.: US 8,584,625 B2
(45) Date of Patent: Nov. 19, 2013

(54) STORAGE TYPE WATER HEATER

(75) Inventor: Masakazu Ando, Nagoya (JP)

(73) Assignee: Rinnai Corporation, Aichi-ken (JP)

( * ) Notice: Subject to any disclaimer, the term of this patent is extended or adjusted under 35 U.S.C. 154(b) by 1045 days.

(21) Appl. No.: 12/614,821

(22) Filed: Nov. 9, 2009

(65) Prior Publication Data

US 2010/0122668 A1 May 20, 2010

(30) Foreign Application Priority Data

Nov. 17, 2008 (JP) ..... 2008-293006

(51) Int. Cl.
*F24D 3/08* (2006.01)
*F24H 1/18* (2006.01)

(52) U.S. Cl.
USPC ..... 122/20 R; 237/19

(58) Field of Classification Search
USPC ..... 122/20 R, 31.1, 33; 237/19; 702/99, 104
See application file for complete search history.

(56) References Cited

U.S. PATENT DOCUMENTS 4,353,410 A * 10/1982 Godard et al. ..... 126/400
4,374,506 A * 2/1983 Whalen ..... 122/20 B
5,020,721 A * 6/1991 Horne ..... 236/20 R
5,322,216 A * 6/1994 Wolter et al. ..... 236/25 R
6,345,769 B2 * 2/2002 MacIntyre ..... 237/8 R
7,735,458 B2 * 6/2010 Stapensea ..... 122/20 R
7,804,047 B2 * 9/2010 Zak et al. ..... 219/494
7,810,456 B2 * 10/2010 Kobayashi ..... 122/31.1
8,191,513 B2 * 6/2012 Krause et al. ..... 122/415
2001/0048032 A1 * 12/2001 Macintyre ..... 237/16
2005/0269254 A1 * 12/2005 Roitman ..... 210/252
2010/0122668 A1 * 5/2010 Ando ..... 122/14.3
2012/0138149 A1 * 6/2012 Hatada et al. ..... 137/1

FOREIGN PATENT DOCUMENTS

JP 60-073324 4/1985
JP 07-167495 7/1995
JP 08-327146 12/1996
JP 09-072610 3/1997

* cited by examiner

*Primary Examiner* — Gregory A Wilson
(74) *Attorney, Agent, or Firm* — Turocy & Watson, LLP

(57) ABSTRACT

A storage type water heater comprising: a stored hot water tank; a heating unit including a heat exchanger, a gas burner, and an air supply fan; a circulation pipe line; a circulating pump; a first temperature sensor for detecting an inlet side temperature T1; a second temperature sensor for detecting an outlet side temperature T2; and a controller including a control arrangement which actuates the circulating pump to circulate the stored hot water inside of the circulation pipe line when the heating unit is in a non-operated state, and determines an abnormality in one of the first temperature sensor and the second temperature sensor based on a temperature difference (|T1−T2|).

2 Claims, 2 Drawing Sheets

STORAGE TYPE WATER HEATER

BACKGROUND OF THE INVENTION

1. Field of the Invention

The present invention relates to a storage type water heater. In particular, the present invention relates to a storage type water heater capable of detecting an abnormality of a temperature sensor disposed on a circulation pipe line.

2. Description of the Related Art

There has been known a conventional storage type water heater comprising: a stored hot water tank for storing stored hot water; a heating unit including a heat exchanger for heating the stored hot water, a gas burner for heating the heat exchanger, and an air supply fan for supplying combustion air to the gas burner; a circulation pipe line for circulating the stored hot water between the stored hot water tank and the heating unit; and a circulating pump for circulating the stored hot water in the circulation pipe line. In this kind of the storage type water heater, in order to heat the stored hot water, the stored hot water is supplied from the stored hot water tank toward the heating unit by actuating the circulating pump, combustion air is blown to the gas burner by actuating the air supply fan, and the gas burner is burnt, whereby heat exchanging in a heat exchanger is operated and the stored hot water heated up to a set temperature is returned to the stored hot water tank. Further, in order to return the stored hot water, which has been heated up to the set temperature, to the stored hot water tank, a temperature sensor for adjusting temperature of the stored hot water is disposed on an outlet side pipe interposed between the stored hot water tank and the heating unit. Specifically, the temperature of the stored hot water detected by the temperature sensor for adjusting the temperature is compared with the set temperature, whereby a flow rate of the stored hot water flowing in the circulation pipe line and a supply amount of gas to be supplied to the gas burner are controlled.

However, in the case where malfunction occurs in the temperature sensor for adjusting temperature or a difference between the temperature detected by the temperature sensor for adjusting the temperature and an actual temperature of the stored hot water is caused by a secular change, there arises a problem that combustion is controlled based on a temperature other than an actual temperature. In view of this, it is desirable to determine an abnormality of the temperature sensor; however, if one temperature having a single thermistor is only used, it is difficult to determine the abnormality of the temperature sensor due to the secular change. A temperature sensor incorporating two thermistors in one protective cylindrical case has been proposed as a temperature sensor for use in a water heater. (For Example, Japanese Unexamined Patent Publication No. S60-73324) According to the temperature sensor including the two thermistors therein, it is possible to determine the abnormality of the temperature sensor by detecting a temperature difference between both of the thermistors. However, such a temperature sensor is expensive, thereby inducing a disadvantage from the viewpoint of a cost. Otherwise, it is conceived that temperature sensors are disposed on not only an outlet side pipe but also an inlet side pipe between a stored hot water tank and a heating unit. According to the storage type water heater having the two temperature sensors, since both of the temperature sensors can detect inlet and outlet side temperatures of the stored hot water, respectively, it is possible to calculate a difference between temperatures of the two temperature sensors by comparing the detected temperatures even when the storage type water heater is operated in a heat retaining operation, whereby the abnormality of the temperature sensor can be determined. However, in the case where the storage type water heater is operated in the heat retaining operation, the abnormality of the temperature sensor needs to be predictively determined based on various factors such as the inlet side temperature of the stored hot water supplied from the stored hot water tank, the outlet side temperature of the stored hot water returned from the heating unit to the stored hot water tank, a heating amount of a gas burner, and a flow rate of the stored hot water flowing in the circulation pipe line. Accordingly, there is a problem that a complicated predictive calculation control is required.

SUMMARY OF THE INVENTION

The present invention has been made to solve the above-mentioned problems and an object of the present invention is to provide a storage type water heater capable of readily and simply determining an abnormality of a temperature sensor with a reduced cost, in which stored hot water supplied from a stored hot water tank is heat-exchanged in a heating unit provided with a heat exchanger to be heated by a gas burner and the heated stored hot water is returned to the stored hot water tank.

According to one aspect of the present invention, there is provided a storage type water heater comprising:

a stored hot water tank;

a heating unit including a heat exchanger for heating stored hot water, a gas burner for heating the heat exchanger, and an air supply fan for supplying combustion air to the gas burner;

a circulation pipe line for circulating the stored hot water between the stored hot water tank and the heating unit;

a circulating pump provided on the circulation pipe line, for circulating the stored hot water in the circulation pipe line;

a first temperature sensor provided on the circulation pipe line, for detecting an inlet side temperature T1 of the stored hot water supplied from the stored hot water tank to the circulation pipe line;

a second temperature sensor provided on the circulation pipe line, for detecting an outlet side temperature T2 of the stored hot water heated in the heating unit; and a controller, wherein the controller includes a control arrangement which actuates the circulating pump to circulate the stored hot water inside of the circulation pipe line when the heating unit is in a non-operated state, and determines an abnormality in one of the first temperature sensor and the second temperature sensor based on a temperature difference ($|T1-T2|$) between the inlet side temperature T1 detected by the first temperature sensor and the outlet side temperature T2 detected by the second temperature sensor.

According to one aspect of the present invention, it is possible to provide the storage type water heater capable of readily and simply determining the abnormality of the temperature sensor with the reduced cost.

Other objects, features and advantages of the present invention will become more fully understood from the detailed description given hereinbelow and the accompanying drawings which are given by way of illustration only, and thus are not to be considered as limiting the present invention.

DETAILED DESCRIPTION OF THE PREFERRED EMBODIMENTS

Referring to drawings, the best mode for carrying out the present invention is described below.

Figure 1:
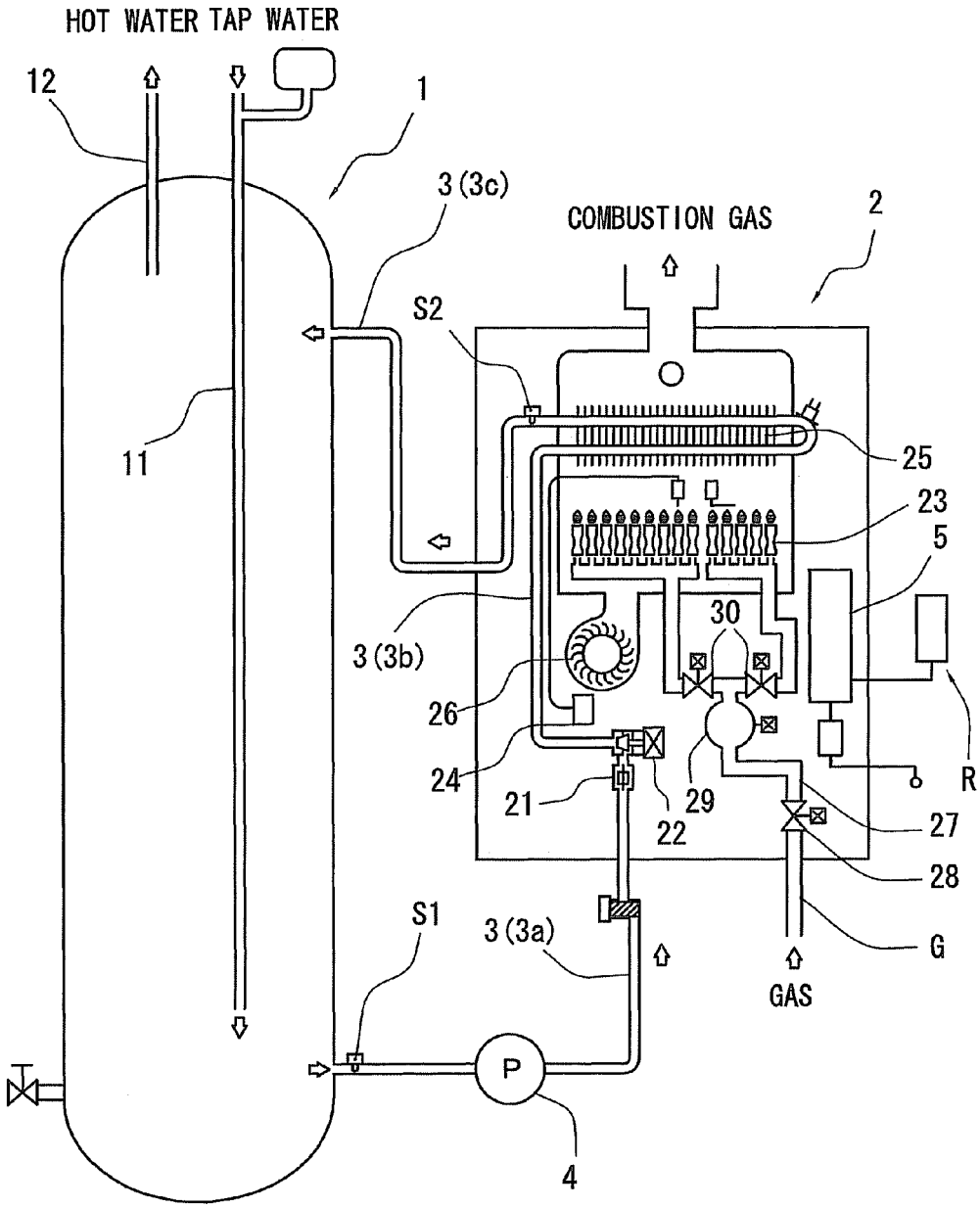
FIG. 1 is a schematic configuration diagram showing a storage type water heater according to an embodiment of the present invention.

FIG. 1 is a schematic configuration diagram showing a storage type water heater according to an embodiment of the present invention. As shown in FIG. 1, the storage type water heater includes a stored hot water tank 1, a heating unit 2, a circulation pipe line 3 for circulating stored hot water between the stored hot water tank 1 and the heating unit 2, a circulating pump 4 for circulating the stored hot water in the circulation pipe line 3, and a controller 5 for controlling an operation of the storage type water heater. The stored hot water tank 1 is connected to a water supply pipe 11 for supplying tap water through a pressure reducing valve (not shown) disposed above the stored hot water tank 1, and further, to a hot-water supply pipe 12 for supplying the stored hot water heated in the heating unit 2 to a hot water supplying terminal such as a bath. The circulation pipe line 3 includes an inlet side pipe 3*a* extending from the lower portion of the stored hot water tank 1 to the heating unit 2, a heating pipe 3*b* housed inside of the heating unit 2 and inserted into a heat exchanger, and an outlet side pipe 3*c* for returning the heated stored hot water from the heating unit 2 to the stored hot water tank 1. The inlet side pipe 3*a*, the heating pipe 3*b*, and the outlet side pipe 3*c* are connected in series. Also, a first temperature sensor S1 for detecting an inlet side temperature T1 of the stored hot water supplied from the stored hot water tank 1 to the circulation pipe line 3, a circulating pump 4, a flow sensor 21 for detecting a flow amount of the stored hot water flowing inside of the circulation pipe line 3, and a flow servo 22 for adjusting a flow rate of the stored hot water flowing inside of the circulation pipe line 3 by controlling an opening degree of the circulation pipe line 3, are provided on the inlet side pipe 3*a*. Further, a second temperature sensor S2 for detecting an outlet side temperature T2 of the stored hot water heated in the heating unit 2 is provided on the outlet side pipe 3*c*. With this configuration, a temperature sensor having a single thermistor is disposed on each of the inlet and outlet side pipes, so that an inexpensive temperature sensor can be used.

The heating unit 2 includes a gas burner 23 for burning gas supplied through a gas pipe G, a sparker 24 for igniting the gas burner, a heat exchanger 25 for recovering combustion heat of the gas and heating the stored hot water flowing in the circulation pipe line 3, and an air supply fan 26 for blowing combustion air into the gas burner 23 and supplying combustion exhaust air from the gas burner 23 to the heat exchanger 25. The gas burner 23 is connected to the gas pipe G through a gas supply pipe line 27. A main gas solenoid valve 28 and a proportional solenoid valve 29 are disposed on the gas supply pipe line 27 in this order from upstream to downstream. The proportional solenoid valve 29 is energized and controlled by a controller 5 so that the proportional solenoid valve 29 is opened with a predetermined opening degree according to the supplied energization amount, whereby a flow rate of gas flowing in the gas supply pipe line 27 is sequentially adjusted. The gas supply pipe line 27 is branched into a gas pipe on one side and a gas pipe on the other side so as to supply the gas to burners in a duplex burner downstream of the proportional solenoid valve 29. Switch solenoid valves 30 for switching the combustion state (ON or OFF) of the burners are respectively disposed on the branch pipes.

Although not shown, each of the first temperature sensor S1 and the second temperature sensor S2 has one single thermistor disposed at a front end portion of a protective cylindrical case. The protective cylindrical case is made of a metal material having high thermal conductivity (for example, stainless steel). Further, the protective cylindrical case is filled with a filling material (for example, epoxy resin). The thermistor in the protective cylindrical case is fixed so as to be in contact with the inner peripheral surface of the protective cylindrical case. With this configuration, heat from the outer surface of the protective cylindrical case is uniformly transmitted to the thermistor via the filling material. The thermistor may be a NTC (Negative Temperature Coefficient) type thermistor having a characteristic that resistance reduces in accordance with a rise in temperature or a PTC (Positive Temperature Coefficient) type thermistor having a characteristic that resistance increases in accordance with a rise in temperature. In this embodiment, both of the thermistors disposed in the first temperature sensor S1 and the second temperature sensor S2 have substantially same detected temperature characteristics.

A controller 5 is electrically connected to a sparker 24, an air supply fan 26, a main gas solenoid valve 28, a proportional solenoid valve 29, switch solenoid valves 30, a flow sensor 21, a flow servo 22, a first temperature sensor S1, a second temperature sensor S2, and a circulating pump 4. Also, the controller 5 is connected to an external operation device R such as a remote controller via a communication cable.

Further, although not shown, the controller 5 includes: an ignition/extinction circuit for controlling ignition/extinction operation of the gas burner 23 according to a flow rate detected by the flow sensor 21; first and second temperature monitors for monitoring temperatures T1 and T2 detected by the first and second temperature sensors S1 and S2, respectively; a combustion control circuit for controlling operations of the proportional solenoid valve 29, the switch solenoid valves 30, and the flow servo 22 in such a manner that the outlet side temperature T2 detected by the second temperature sensor S2 becomes equal to a set temperature set by an external operation device R; an error estimator for estimating an occurrence of an error in the heating unit 2 or the second temperature sensor S2 when the outlet side temperature T2 detected by the second temperature sensor S2 for adjusting the temperature is kept lower or higher by a predetermined value or more than the set temperature for a predetermined period of time; a temperature comparator for comparing the inlet side temperature T1 detected by the first temperature sensor S1 and the outlet side temperature T2 detected by the second temperature sensor S2 to calculate a temperature difference (|T1−T2|) therebetween; a sensor abnormality determining unit for determining a sensor abnormality when the temperature difference (|T1−T2|) is greater than a predetermined value; an notifying unit for notifying the sensor abnormality via a display and a voice output unit in the external operation device R when the sensor abnormality determining unit determines the sensor abnormality; a timer for measuring a standby time when the abnormality is determined; and a microcomputer storing therein a program for allowing those control circuits to be associated with each other.

A heat retaining operation of a storage type water heater in the present embodiment will be first described. When the inlet side temperature T1 detected by the first temperature sensor S1 becomes a predetermined temperature or lower, the controller 5 actuates the circulating pump 4, thereby circulating the stored hot water inside of the circulation pipe line 3. Also, the controller 5 actuates the air supply fan 26, opens the main gas solenoid valve 28, and ignites the gas burner 23 with the sparker 24, so that the heating unit 2 is actuated. Since the outlet side temperature T2 of the stored hot water detected by the second temperature sensor S2 disposed on the outlet side pipe 3*c* is input into the second temperature monitor, the opening degree of the proportional solenoid valve 29 for adjusting the gas amount is adjusted and the switch solenoid valves 30 are opened/closed based on the outlet side temperature T2 in such a manner that the outlet side temperature T2 becomes equal to the set temperature. Further, the opening degree of the circulation pipe line 3 is adjusted by the flow servo 22, so that the flow rate of the stored hot water flowing inside of the circulation pipe line 3 is adjusted. As the outlet side temperature T2 detected by the second temperature sensor S2 is increased, the controller 5 controls the operations of the proportional solenoid valve 29 and the switch solenoid valves 30, thereby adjusting the heat retaining operation so as to decrease the heating amount. When the outlet side temperature T2 is held at a constant temperature for a predetermined period of time, the heating unit 2 is stopped from being operated, and therefore, the circulating pump 4 is also stopped. With this, the heat retaining operation comes to an end. At this time, in the case where the outlet side temperature T2 detected by the second temperature sensor S2 serving as a temperature adjusting sensor is continuously held at a temperature lower or higher by a predetermined value or more than the set temperature for a constant period of time, the error estimator determines that an abnormality occurs in the heating unit 2 or the second temperature sensor S2 and the error estimator sends an error signal to a combustion control circuit, thereby stopping the heat retaining operation of the heating unit 2. With this control arrangement, it is possible to determine the abnormality of the heating unit 2 or the second temperature sensor S2 during the heat retaining operation, whereby supply of cold stored water which is not heated or supply of stored very hot water can be prevented. The combustion of the heat retaining operation in the above description is controlled only based on the outlet side temperature T2 of the stored hot water. However, the inlet side temperature T1 of the stored hot water flowing inside of the inlet side pipe 3*a* may be further detected by the first temperature sensor S1 during the heat retaining operation, so that the combustion of the heat retaining operation may be controlled based on both of the inlet side temperature T1 and the outlet side temperature T2.

Figure 2:
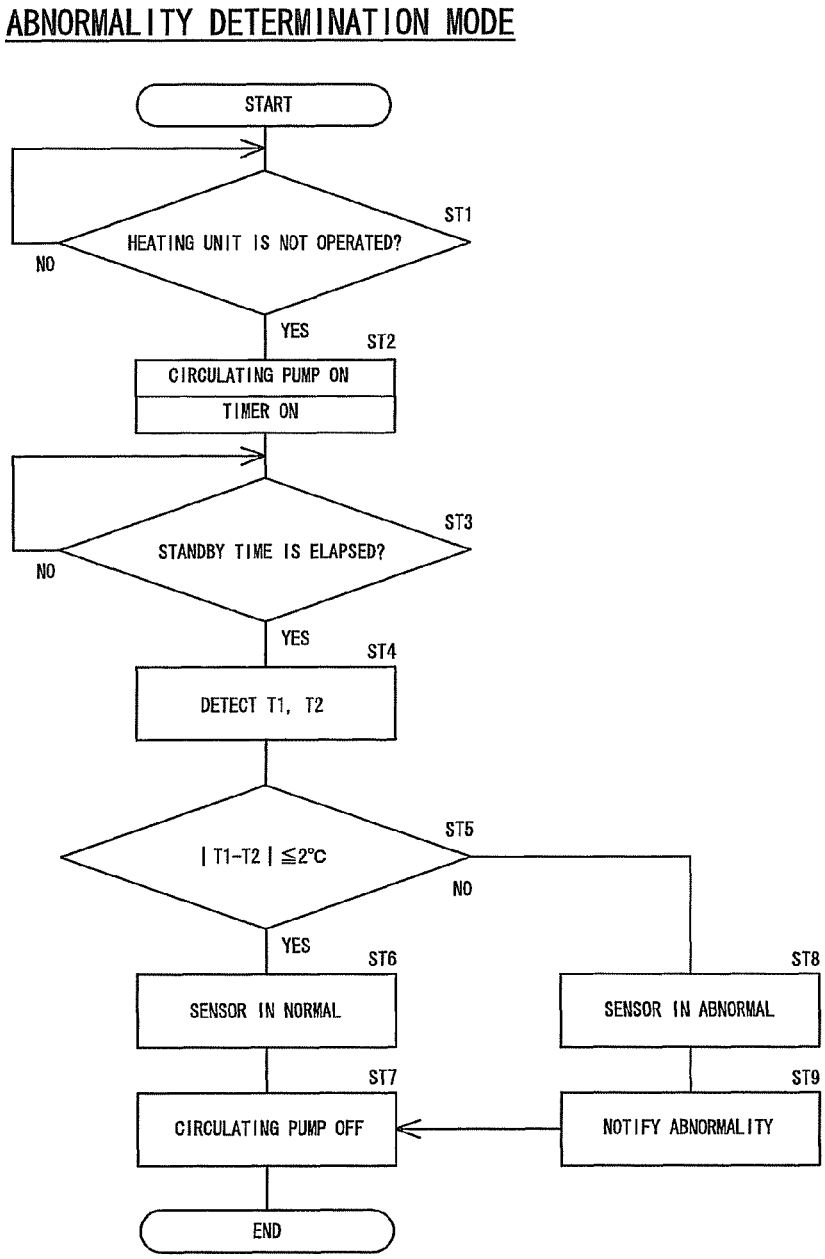
FIG. 2 is an operation flowchart for determining an abnormality of a temperature sensor according to the embodiment of the present invention.

Next, description will be made on a control arrangement for determining the abnormality in one of temperature sensors when the temperature sensor is deteriorated due to a secular change or the like in the storage type water heater of the present embodiment with reference to a flowchart of FIG. 2. In this embodiment, the storage type water heater is set in such a manner that an abnormality determination mode of the temperature sensor is started every time after the heat retaining operation is completed. Upon completion of the heat retaining operation, the controller 5 starts the abnormality determination mode. In the abnormality determination mode, the controller 5 firstly confirms whether the heating unit 2 is in a non-operation state (step ST1). The non-operation state of the heating unit 2 can be confirmed based on the extinction of the gas burner 23 and the stoppage of the air supply fan 26. With this control arrangement, if the abnormality of the first temperature sensor S1 or second temperature sensor S2 is determined when the heating unit 2 is in the non-operation state, various factors such as the heating amount of the gas burner 23 and the flow rate of the stored hot water flowing in the circulation pipe line 3 need not be taken into consideration, since the temperature of the stored hot water flowing in the circulation pipe line 3 is substantially the same at any position. Accordingly, different from the case of determination of an abnormality of a temperature sensor during the heat retaining operation, the abnormality of the temperature sensor can be determined only by comparing the temperatures detected by both of the temperature sensors S1 and S2 with each other. Further, since the air supply fan 26 is not rotated in the non-operation state of the heating unit 2, the circulation pipe line 3 can be prevented from being cooled by air blown from the air supply fan 26 to the heat exchanger 25. As a result, it is possible to prevent any generation of the difference between the temperatures detected by both of the temperature sensors S1 and S2.

When the non-operation state of the heating unit 2 is confirmed (YES in step ST1), the controller 5 actuates the circulating pump 4, and further, starts the timer (step ST2), and then, stands by for a predetermined standby time (for example, 1 minute) (step ST3). In other words, if the abnormality is determined immediately after the completion of the heat retaining operation by the heating unit 2, the heated stored hot water may remain in the circulation pipe line 3, and therefore, the temperature of the stored hot water reserved in the stored hot water tank 1 may not be substantially equal to the temperature of the stored hot water flowing in the circulation pipe line 3. As a result, it is conceived that the temperature difference between the inlet side temperature T1 of the stored hot water supplied from the stored hot water tank 1 and the outlet side temperature T2 of the stored hot water returned from the heating unit 2 to the stored hot water tank 1 may be larger. In view of this, if the abnormality in one of the first and second temperature sensors S1 and S2 is determined by after a lapse of a predetermined period of time upon the completion of the heat retaining operation by the heating unit 2, the abnormality of the temperature sensor can be more accurately determined. Incidentally, the flow sensor 21 can confirm whether or not the stored hot water is circulated in the circulation pipe line 3 by the operation of the circulating pump 4.

After the predetermined standby time (YES in step ST3) is elapsed, the first and second temperature sensors S1 and S2 detect the inlet side temperature T1 and the outlet side temperature T2 of the stored hot water, respectively and detection signals indicative of the detected temperatures are sent to the first and second temperature monitors, respectively (step ST4).

Subsequently, the temperature comparator compares the inlet side temperature T1 detected by the first temperature sensor S1 with the outlet side temperature T2 detected by the second temperature sensor S2, thereby determining whether or not the difference (|T1−T2|) between both of the temperatures falls within a predetermined temperature range (for example, within 2° C.) (step ST5). When the temperature difference (|T1−T2|) ranges within 2° C. (YES in step ST5), the sensor abnormality determining unit determines that the first and second temperature sensors 51 and S2 are normal (step ST6), and thus the controller 5 stops the circulating pump 4 (step ST7).

On the other hand, when it is determined in step ST5 that the temperature difference (|T1−T2|) is higher than 2° C. (NO in step ST5), for example, when an excessively low temperature is detected due to a breakage of a resistor disposed inside of one of the temperature sensor, the temperature detection accuracy of either one of the temperature sensors may be deteriorated. Therefore, the sensor abnormality determining unit outputs an abnormality signal to the notifying unit, so that the display and the voice output unit in the external operation device R notify that either one of the temperature sensors S1 and S2 is abnormal. In this case, the occurrence of the abnormality in the temperature sensor may be notified to a service station via a telephone line.

Other Embodiments i) In the above-described embodiment, the abnormality in one of the first and second temperature sensors is determined when the difference between the temperatures detected by the first and second temperature sensors is generated. Alternatively, one or more temperature sensors may be additionally disposed on the circulating pipe line or in the stored hot water tank, so that an abnormality in one of temperature sensors may be determined by using three or more temperature sensors. According to this configuration, since three or more temperature sensors are used, it is possible to determine the abnormality of the temperature sensor more accurately. Further, since temperatures detected by three or more temperature sensors are compared, if one of the temperature sensors is abnormal, there is a high possibility that temperature detected by the one abnormal temperature sensor is different from temperatures detected by the other normal temperature sensors. Therefore, it is possible to determine which of the temperature sensors abnormally detects the temperature.

ii) In the above-described embodiment, the abnormality is determined only based on the difference between the temperatures detected by the first and second temperature sensors. Alternatively, the controller may additionally include a memory unit for storing a temperature of the stored hot water at the time of the previous determination of the abnormality, so that the previous temperature stored in the memory unit may be further compared with the temperatures detected by the first and second temperature sensors. With such a configuration, it is possible to determine which of the first and second temperature sensors abnormally detects the temperature.

iii) In the above-described embodiment, the circulating pump is started to be actuated when the abnormality determination mode is performed. Otherwise, the stored hot water may be circulated in the circulation pipe line without stopping the circulating pump after the completion of the heat retaining operation.

As describe above in detail, according to one aspect of the present invention, there is provided a storage type water heater comprising:

a stored hot water tank;

a heating unit including a heat exchanger for heating stored hot water, a gas burner for heating the heat exchanger, and an air supply fan for supplying combustion air to the gas burner;

a circulation pipe line for circulating the stored hot water between the stored hot water tank and the heating unit;

a circulating pump provided on the circulation pipe line, for circulating the stored hot water in the circulation pipe line;

a first temperature sensor provided on the circulation pipe line, for detecting an inlet side temperature T1 of the stored hot water supplied from the stored hot water tank to the circulation pipe line;

a second temperature sensor provided on the circulation pipe line, for detecting an outlet side temperature T2 of the stored hot water heated in the heating unit; and a controller, wherein the controller includes a control arrangement which actuates the circulating pump to circulate the stored hot water inside of the circulation pipe line when the heating unit is in a non-operated state, and determines an abnormality in one of the first temperature sensor and the second temperature sensor based on a temperature difference ($|T1-T2|$) between the inlet side temperature T1 detected by the first temperature sensor and the outlet side temperature T2 detected by the second temperature sensor.

In the storage type water heater above, the temperature sensor having a single thermistor is disposed on each of the inlet and outlet side pipes, in order to determine the abnormality in one of the temperature sensors, the stored hot water is circulated in the circulation pipe line by actuating the circulating pump when the heating unit is in a non-operated state. If the heating unit is in the non-operation state, the temperature of the stored hot water supplied from the stored hot water tank is substantially same as the temperature of the stored hot water returned to the stored hot water tank. Accordingly, various factors such as the heating amount of the gas burner and the flow rate of the stored hot water flowing in the circulation pipe line 3 need not be taken into consideration, different from the case of determination of the abnormality during the heat retaining operation. As a result, it is possible to readily determine the abnormality of the temperature sensor only by comparing the temperatures detected by the temperature sensors. Further, there is a possibility that since the air supply fan is rotated when the heating unit is in an operated state, the difference between the temperatures detected by both of the temperature sensors may be larger due to air blowing of the air supply fan. However, according to the storage type water heater above, since the air supply fan is not rotated in the non-operation state of the heating unit, the circulation pipe line can be prevented from being cooled by air blown from the air supply fan. As a result, it is possible to prevent any generation of the difference between the temperatures detected by both of the temperature sensors. Furthermore, according to the storage type water heater above, since the temperature sensor having a single thermistor is disposed on each of the inlet and outlet side pipes, an inexpensive temperature sensor can be used. Moreover, as a conventional storage type water heater, if the abnormality of the temperature sensor is determined during the heat retaining operation is performed, the heat retaining operation can not be started until the abnormality determination mode is completed; however, according to the storage type water heater above, since the abnormality determination mode is performed in a non-operated state of the heating unit (for example, after the completion of the heat retaining operation), the heat retaining operation can be started without waiting the completion of the abnormality determination mode, whereby convenience of the storage type water heater is not hindered.

In the storage type water heater above, the controller may determine the abnormality in one of the first temperature sensor and the second temperature sensor after a lapse of a predetermined period of time upon the completion of a heat retaining operation by the heating unit.

When the abnormality is determined immediately after the completion of the heat retaining operation by the heating unit, the heated stored hot water may remain in the circulation pipe line, and therefore, the temperature of the stored hot water reserved in the stored hot water tank may not be substantially equal to the temperature of the stored hot water flowing in the circulation pipe line. Therefore, the temperature difference between the inlet side temperature T1 of the stored hot water supplied from the stored hot water tank and the outlet side temperature T2 of the stored hot water returned from the heating unit to the stored hot water tank may be larger. On the other hand, if the abnormality is determined by the first and second temperature sensors S1 and S2 after a lapse of a predetermined period of time upon the completion of the heat retaining operation by the heating unit, the abnormality can be more accurately determined.

In the storage type water heater above, the controller includes as the control arrangement:

a first temperature monitor for monitoring the inlet side temperature T1 detected by the first temperature sensor;

a second temperature monitor for monitoring the outlet side temperature T2 detected by the second temperature sensor;

a temperature comparator for comparing the inlet side temperature T1 detected by the first temperature sensor and the outlet side temperature T2 detected by the second temperature sensor to calculate the temperature difference (|T1−T2|) therebetween; and a sensor abnormality determining unit for determining the abnormality when the temperature difference (|T1−T21) is greater than a predetermined value.

The present application claims a priority based on a Japanese Patent Application No. 2008-293006 filed on Nov. 17, 2008, the content of which is hereby incorporated by reference in its entirely.

Although the present invention has been described in detail, the foregoing descriptions are merely exemplary at all aspects, and do not limit the present invention thereto. It should be understood that an enormous number of unillustrated modifications may be assumed without departing from the scope of the present invention.

What is claimed is:

1. A storage type water heater comprising:

a stored hot water tank;

a heating unit including a heat exchanger for heating stored hot water, a gas burner for heating the heat exchanger, and an air supply fan for supplying combustion air to the gas burner;

a circulation pipe line for circulating the stored hot water between the stored hot water tank and the heating unit;

a circulating pump provided on the circulation pipe line, for circulating the stored hot water in the circulation pipe line;

a first temperature sensor provided on the circulation pipe line, for detecting an inlet side temperature T1 of the stored hot water supplied from the stored hot water tank to the circulation pipe line;

a second temperature sensor provided on the circulation pipe line, for detecting an outlet side temperature T2 of the stored hot water heated in the heating unit;

a flow sensor for detecting a flow amount of the stored hot water flowing inside of the circulation pipe line; and a controller, including:

a first temperature monitor for monitoring the inlet side temperature T1 detected by the first temperature sensor;

a second temperature monitor for monitoring the outlet side temperature T2 detected by the second temperature sensor;

a temperature comparator for comparing the inlet side temperature T1 detected by the first temperature sensor and the outlet side temperature T2 detected by the second temperature sensor to calculate the temperature difference (|T1−T2|) therebetween;

a sensor abnormality determining unit for determining the abnormality when the temperature difference (|T1−T2|) is greater than a predetermined value, and a notifying unit for sending a notification of the sensor abnormality in response to the sensor abnormality and performing an abnormality determination mode which actuates the circulating pump to circulate the stored hot water inside of the circulation pipe line when the heating unit is in a non-operated state, and determines the sensor abnormality in one of the first temperature sensor and the second temperature sensor based on a temperature different (|T1−T2|) between the inlet side temperature T1 detected by the first temperature sensor and the outlet side temperature T2 detected by the second temperature sensor; and an external operation device for presenting a notification about the sensor abnormality from at least one of a display and a speaker.

2. The storage type water heater according to claim 1, wherein the abnormality in one of the first temperature sensor and the second temperature sensor is determined after a lapse of a predetermined period of time upon the completion of a heat retaining operation by the heating unit.

* * * * *